United States Patent [19]

Provence et al.

[11] Patent Number: 4,959,913

[45] Date of Patent: Oct. 2, 1990

[54] CROSS-COUNTRY SKI SHOE FOR USE WITH AN ELASTIC BIASING ELEMENT

[75] Inventors: Marc Provence, Thorens les Glieres; Didier Rousset, Lescheraines; Josiane Dunand, Cran Gevrier, all of France

[73] Assignee: Salomon S.A., Annecy Cedex, France

[21] Appl. No.: 378,320

[22] Filed: Jul. 11, 1989

[30] Foreign Application Priority Data

Jul. 13, 1988 [FR] France ..... 88-09982

[51] Int. Cl.[5] ..... A43B 5/04

[52] U.S. Cl. ..... 36/117

[58] Field of Search ..... 36/117, 118, 119, 120, 36/121, 615; 280/626

[56] References Cited

U.S. PATENT DOCUMENTS

| | | | |
|---|---|---|---|
| 4,309,833 | 1/1982 | Salomon | 36/117 |
| 4,484,762 | 11/1984 | Salomon | 36/117 X |
| 4,487,427 | 12/1984 | Salomon | 36/117 X |
| 4,562,653 | 1/1986 | Salomon | 36/117 |

FOREIGN PATENT DOCUMENTS

| | | | |
|---|---|---|---|
| 250021 | 5/1987 | European Pat. Off. | 36/117 |
| 0278859 | 2/1988 | European Pat. Off. . | |
| 3401080 | 8/1984 | Fed. Rep. of Germany | 36/117 |
| 2609408 | 7/1988 | France . | |
| 8706802 | 11/1987 | PCT Int'l Appl. | 36/117 |
| 8805271 | 7/1988 | PCT Int'l Appl. | 36/117 |

*Primary Examiner*—Paul T. Sewell
*Assistant Examiner*—Andrew D. Meyers
*Attorney, Agent, or Firm*—Sandler, Greenblum & Bernstein

[57] ABSTRACT

A cross-country ski shoe having a journal axle to allow the shoe to be journalled on a cross-country ski. A support surface on the shoe is adapted to contact an elastic element on the binding which exerts a return force on the shoe when it is pivoted upwardly about the journal axle. The journal axle is positioned beneath and to rear of the elastic element so that forces from the elastic element are not transmitted to the journal axle, giving the skier better control of the ski.

20 Claims, 2 Drawing Sheets

CROSS-COUNTRY SKI SHOE FOR USE WITH AN ELASTIC BIASING ELEMENT

BACKGROUND OF THE INVENTION

1. Field of the Invention

The present invention relates to a shoe used for cross-country skiing. This shoe is of the type having at its front end a transverse axis adapted to allow for the journalling of the shoe on the ski, and a support surface for an elastic element of the binding system which exerts a return force on the shoe when it is pivoted upwardly about its journal axis.

2. Description of Background Relevant Information

A shoe 1 of this known type is shown in partial longitudinal cross-section in FIG. 1, and likewise in a partial top view in FIG. 2. The shoe 1 includes an upper 2 connected peripherally to a sole 3 in a known manner. The sole 3 is provided at its front end with a projection 4, having the shape of a substantially parallelepiped block. The projection 4 is traversed on both sides by transverse arm 6 of an attachment loop 5 which is molded into the sole. The two portions 6*a* of the arm 6 that extend on both sides of projection 4 are adapted to cooperate with complementary portions of a binding and serve as a journal axle for the shoe on the ski. The vertical surface 4*a* of projection 4 serves as a support surface for an elastic bumper 7 which is part of the cross-country ski binding (not shown in the drawing). This elastic bumper 7 is adapted, in a known manner, to exert a return force on the shoe when it is lifted from the upper surface of the ski by pivoting about journal axle 6*a*.

In this known shoe, the elastic bumper 7 exerts a force not only on the support surface 4*a* of the sole but also on the journal axle 6*a* since the journal axle is located behind the support surface of the elastic bumper.

When the shoe is lifted, the elastic bumper is compressed over the entire surface of the support surface, which includes the location of the journal axle, and it consequently exerts a force on the axle which tends to push it upwardly. Thus, the journal axis is subjected to significant forces.

Furthermore, since the journal axle projects on both sides of projection 4, it is unprotected and is therefore very sensitive to shocks.

Also, in this known shoe, the journal axle is located quite far from the toes of the skier because of its position on the projecting portion of the sole of the shoe. This reduces the skier's control of the reactions and performance of the ski.

SUMMARY OF THE INVENTION

The present invention relates to a cross-country skiing shoe having a transverse journal axle at its front end for journalling the shoe on the ski and a support surface adapted to contact an elastic element of the binding which exerts a return force on the shoe when the shoe is pivoted upwardly about the axle. The journal axle is spaced a predetermined distance beneath the support surface of the the elastic element. More particularly, at least a portion of the journal axle is positioned to the rear of a plane extending from the support surface or substantially tangentially to the plane of the support surface. The plane of the upper surface is substantially vertical.

According to another aspect of the invention, the axle is affixed at its ends in lateral side plates of a sole of the shoe. A plane extending through the axle extends substantially tangentially to an upper of the shoe in the area of its connection with the front end of the sole. Preferably, the axle is positioned substantially in the area of the sole of the shoe that supports the toes of a wearer.

According to another aspect of the invention, the support surface for the elastic element is formed on a front end of the sole of the shoe and may be formed on a portion extending upwardly from the front end of the sole.

According to another aspect of the invention, a plane extending through said axle extends to the rear of an area of connection of an upper with the front end of a sole of the shoe.

The cross-country ski shoe of this invention includes a transverse journal axle at the front end of the shoe adapted for journalling the shoe on a cross-country ski and a support surface at the front end of the shoe adapted to contact an elastic element on a binding which exerts a return force on the shoe when it is pivoted upwardly about the journal axle. The journal axle is spaced a predetermined distance beneath the support surface and at least a portion of the journal axle is positioned to the rear of a plane extending from the support surface. The journal axle may be positioned substantially tangentially to the plane, which is substantially vertical.

The shoe includes a sole having lateral side plates and the journal axle is affixed at its ends to the lateral side plates.

According to another aspect of the invention, the shoe further includes an upper connected at its front end to a sole and a plane extending through the journal axle extends substantially tangentially to the connection of the upper to the sole. The plane extending through the journal axle may extend to the rear of the connection of the upper to the sole.

According to another aspect of the invention, the shoe includes a sole adapted to support the toes of a wearer and journal axle is positioned substantially in the area of the sole that supports the toes.

BRIEF DESCRIPTION OF THE DRAWINGS

The invention is further explained in the description which follows with reference to the drawings, illustrating by way of a non-limiting example, one preferred embodiment of the present invention wherein.

DETAILED DESCRIPTION OF THE PREFERRED EMBODIMENTS

It is an object of the present invention to overcome the disadvantages of the known shoe described above, and in particular to provide a cross-country ski shoe of the above type, in which the journal axle is protected and is not subjected to forces by the elastic biasing element, and which allows the skier to have good sensation and good control of his or her skis.

This object is achieved by positioning the journal axle beneath the support surface of the elastic element. Thus, the journal axle is totally independent of the support surface and is not subjected to any forces from the elastic element.

According to a preferred embodiment, the journal axle is positioned substantially tangentially or to the rear of the support surface. By using this construction, the risk of the axle striking the elastic element when the shoe is inserted into or removed from the binding is eliminated. Furthermore, this position is closer to the toes of the skier than that of the known shoe and therefore improves the sensation of the skier and control of the ski.

Preferably, the axle is affixed at its ends in lateral side plates of the sole. In this manner, the axle is protected by the side plates even while walking. Furthermore, this arrangement gives the shoe a better appearance. Preferably the axle is located substantially tangentially or to the rear of the connection of the upper of the shoe in the area where it is connected with the front end of the sole. This arrangement makes it possible to substantially eliminate any projecting portion towards the front of the shoe. It also makes it possible to substantially improve the rigidity of the area of the journal axle, which is advantageous for better control of the ski.

Figure 1:
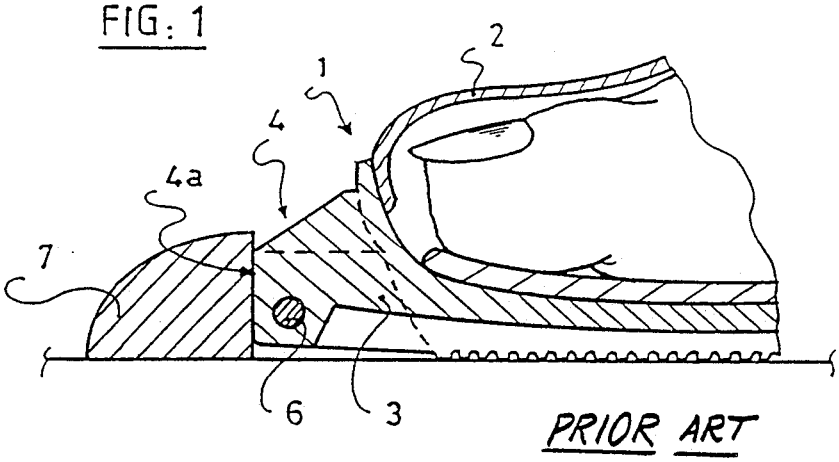
FIGS. 1 and 2 show a prior art shoe.
Figure 2:
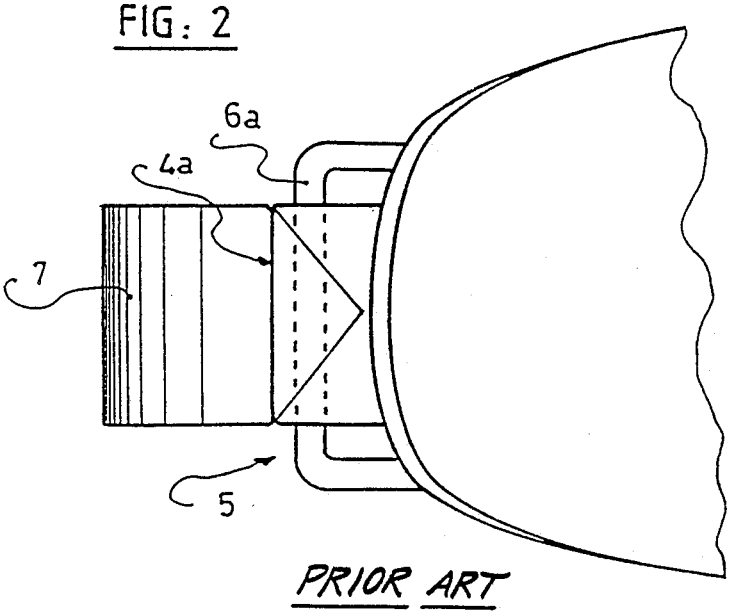
Figure 3:
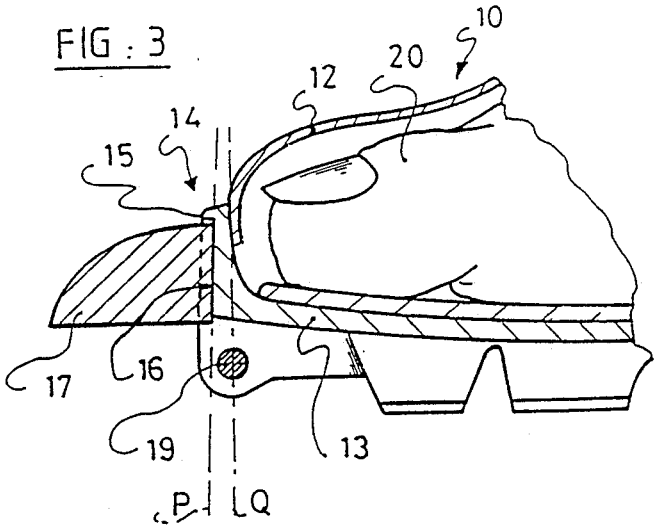
FIG. 3 is a partial longitudinal cross sectional view of a shoe according to the invention.
Figure 4:
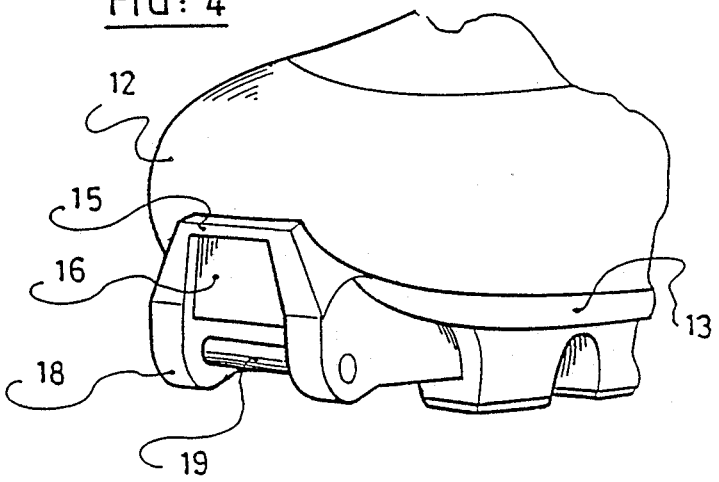
FIG. 4 is a perspective view of the front of the shoe according to FIG. 3.

FIGS. 3 and 4 show the front end of a shoe 10 according to the invention. Shoe 10 comprises, in a known manner, an upper 12 which is connected peripherally to a sole 13.

As particularly shown in FIG. 3, the sole 13 has at its front end a portion 14 which extends along and is glued to upper 12 of the shoe. This arrangement makes it possible to improve the connection of upper 12 to sole 13 at the front of the shoe and increases the resistance of separation of the upper and sole because of the greater gluing surface available.

The front portion 14 of sole 13 includes a support surface 16 that is retracted from front surface 15, and is adapted to cooperate with an elastic element 17 of the binding, (the binding not being shown for greater clarity). In the drawing, the support surface 16 is shown as being substantially vertical, but can likewise be slightly inclined, particularly from top to bottom towards the rear.

The front portion 14 of the sole includes two parallel lateral side plates 18 located beneath and on both sides of support surface 16. An end of a journal axle 19 is embedded in each of the side plates 18. The embedding may be achieved by molding the axle into the sole. The journal axle 19 is therefore positioned beneath and is spaced from the support surface 16 of elastic element 17.

The axle 19 is adapted to be inserted into an associated portion of the binding (not shown in the drawing) to achieve the journalled mounting of the shoe on the ski. The elastic element 17 exerts a return force on the shoe when it is lifted from the upper surface of the ski as it pivots by axle 19. As previously indicated, the separation between the journal axle 19 and the support surface 16 makes it possible to protect the axle from any force exerted by elastic element 17.

As shown more particularly in FIG. 3, the journal axle 19 is positioned to the rear of support surface 16 of the elastic element 17. Because of this arrangement, there is no risk of axle 19 striking the elastic element 17 during the insertion of the shoe in the binding.

Axle 19 may be located in a manner so as to be tangent to the plane P of support surface 16, as shown in the drawing, but can also be located more to the rear of plane P. The plane P is considered to be the plane in which is contained the support surface 16, or a major portion thereof in the case where the surface is not totally planar.

The position of axle 19 at the rear with respect to the front end 15 of sole 13 has the advantage of bringing this axle close to a position beneath the toes 20 of the skier, which improves the sensations, reactions and behavior of the ski for the skier. This is particularly important when the heel of the shoe is lifted with respect to the ski, since at this moment, it is by means of the toes that the skier guides the ski. The further that axle 19 is situated towards the rear, and the more that it is plumb with the toes, the better will be the sensation and guidance of the ski.

By offsetting the journal axle 19, and more precisely eliminating the projecting forces of known shoes makes it possible to ensure a much more homogeneous and solid connection of the shoe to the ski, thereby improving the precision during the pivoting of the shoe.

As is seen in FIG. 3, the journal axle 19 is placed such that its axis is contained in plane Q which is tangentially arranged with respect to the front end of upper 12 of the shoe, or it may be located to the rear of this plane. This arrangement makes it possible to guarantee that the axle 19 does not project beyond the front of the shoe.

As is shown in FIGS. 3 and 4, the journal axle 19 is totally protected from the exterior, on its sides and towards the bottom by the side plates 18 in which the ends are embedded, as well as towards the front and rear because of its recessed position in the sole.

The present invention is not limited only to the embodiment shown by way of a non-limiting example, but includes all similar or equivalent embodiments. For example, the support surface of the elastic element can be on the upper of the shoe itself, in particular where the sole does not have a front portion rising along the upper.

Although the invention has been described with reference to particular means, materials and embodiments, it is to be understood that the invention is not limited to the particulars disclosed and extends to all equivalents within the scope of the claims.

We claim:

1. Cross-country skiing shoe having a transverse journal axle at its front end for journalling the shoe on a ski and a support surface on said shoe adapted to contact an elastic element of a binding which exerts a return force on the shoe when the shoe is pivoted upwardly about the axle, the improvement comprising the journal axle being spaced a predetermined distance beneath the support surface for the elastic element.

2. The shoe according to claim 1, wherein at least a portion of said journal axle is positioned to the rear of a plane extending from said support surface.

3. The shoe according to claim 2, wherein said journal axle is positioned substantially tangentially to said plane extending from said support surface.

4. The shoe according to claim 2, wherein said plane extending from said surface is substantially vertical.

5. The shoe according to claim 1, wherein said axle is affixed at its ends in lateral side plates of a sole of said shoe.

6. The shoe according to claim wherein a plane extending through said axle extends substantially tangentially to an upper of the shoe in the area of its connection with the front end of a sole of the shoe.

7. The shoe according to claim 1, wherein said axle is positioned substantially in the area of a sole of the shoe that supports the toes of a wearer.

8. The shoe according to claim 1, wherein said support surface for the elastic element is formed on a front end of a sole of the shoe.

9. The shoe according to claim 8, wherein said support surface is formed on a portion extending upwardly from the front end of the sole.

10. The shoe according to claim 1, wherein a plane extending through said axle extends to the rear of an area of connection of an upper with the front end of a sole of the shoe.

11. A cross-country ski shoe comprising:

(a) a transverse journal axle at the front end of the shoe adapted for journalling the shoe on a cross-country ski; and (b) a support surface at the front end of the shoe adapted to contact an elastic element of a binding which exerts a return force on the shoe when it is pivoted upwardly about said journal axle, said journal axle being spaced a predetermined distance beneath said support surface.

12. The shoe according to claim 11, wherein at least a portion of said journal axle is positioned to the rear of a plane extending from said support surface.

13. The shoe according to claim 12, wherein said journal axle is positioned substantially tangentially to said plane.

14. The shoe according to claim 12, wherein said plane is substantially vertical.

15. The shoe according to claim 11, wherein said shoe includes a sole having lateral side plates, said journal axle being affixed at its ends to said lateral side plates.

16. The shoe according to claim 11, said shoe further comprising an upper connected at its front end to a sole, and wherein a plane extending through said journal axle extends substantially tangentially to the connection of said upper to said sole.

17. The shoe according to claim 11, said shoe further comprising an upper connected at its front end to a sole, and wherein a plane extending through said journal axle extends to the rear of the connection of said upper to said sole.

18. The shoe according to claim 11, said shoe further comprising a sole adapted to support the toes of a wearer, wherein said journal axle is positioned substantially in the area of the sole that supports the toes.

19. The shoe according to claim 11, said shoe further comprising a sole, said support surface being formed on a front end of said sole.

20. The shoe according to claim 19, wherein a front portion of said sole extends upwardly, said support surface being formed on said front portion of said sole.

* * * * *

UNITED STATES PATENT AND TRADEMARK OFFICE

CERTIFICATE OF CORRECTION

PATENT NO. : 4,959,913

DATED : October 2, 1990

INVENTOR(S) : PROVENCE et al.

It is certified that error appears in the above-identified patent and that said Letters Patent is hereby corrected as shown below:

Column 4, line 62 (claim 6, line 1), insert ---1,--- after "claim".

Signed and Sealed this

Sixteenth Day of February, 1993

*Attest:*

STEPHEN G. KUNIN

*Attesting Officer*

*Acting Commissioner of Patents and Trademarks*